US011898294B2

(12) United States Patent
Kim et al.

(10) Patent No.: US 11,898,294 B2
(45) Date of Patent: Feb. 13, 2024

(54) WASHING MACHINE

(71) Applicant: LG Electronics Inc., Seoul (KR)

(72) Inventors: Hyemin Kim, Seoul (KR); Sooyoung Oh, Seoul (KR); Kyosoon Chae, Seoul (KR); Jinho Kim, Seoul (KR); Heeyeon Kim, Seoul (KR); Beomjun Kim, Seoul (KR); Seungwoo Park, Seoul (KR)

(73) Assignee: LG Electronics Inc., Seoul (KR)

( * ) Notice: Subject to any disclaimer, the term of this patent is extended or adjusted under 35 U.S.C. 154(b) by 232 days.

(21) Appl. No.: 17/414,170

(22) PCT Filed: Nov. 15, 2019

(86) PCT No.: PCT/KR2019/015630
§ 371 (c)(1),
(2) Date: Jun. 15, 2021

(87) PCT Pub. No.: WO2020/101422
PCT Pub. Date: May 22, 2020

(65) Prior Publication Data

US 2022/0034020 A1 Feb. 3, 2022

(30) Foreign Application Priority Data

Nov. 15, 2018 (KR) ..... 10-2018-0140638

(51) Int. Cl.
*D06F 39/02* (2006.01)
*D06F 33/37* (2020.01)
(Continued)

(52) U.S. Cl.
CPC ..... *D06F 39/022* (2013.01); *D06F 23/06* (2013.01); *D06F 33/37* (2020.02); *D06F 33/57* (2020.02); *D06F 2105/42* (2020.02)

(58) Field of Classification Search
CPC ..... D06F 23/06; D06F 33/37; D06F 33/57; D06F 39/022; D06F 2105/42
See application file for complete search history.

(56) References Cited

U.S. PATENT DOCUMENTS 5,140,747 A 8/1992 Barnett et al.
9,644,307 B2 * 5/2017 Da Pont ..... D06F 39/02
(Continued)

FOREIGN PATENT DOCUMENTS

DE 3447303 7/1993
DE 102014111389 2/2016
(Continued)

OTHER PUBLICATIONS

Electronic translation of EP-2985464-A1 to Behr. (Year: 2016).*
(Continued)

*Primary Examiner* — Joseph L. Perrin
(74) *Attorney, Agent, or Firm* — Fish & Richardson P.C.

(57) ABSTRACT

A washing machine includes a tub containing water, a drum rotatably provided in the tub to accommodate laundry, and a detergent mixing device configured to mix additives supplied into the tub. The detergent mixing device includes a pair of additive cartridges containing a liquid additive and a peristaltic pump configured to selectively supply the additive discharged from the pair of additive cartridges to the tub. The peristaltic pump includes a first path switching motor, a first tub, a second tube, a first rotor and a second rotor rotated by the flow path switching motor, a first rotary bearing permitting a rotation of the first rotor in a first direction and restricting a rotation of the first rotor in a second direction, and a second rotary bearing permitting a rotation of the second rotor in the second direction and restricting a rotation of the second rotor in the first direction.

4 Claims, 12 Drawing Sheets

(51) Int. Cl.

| | |
|---|---|
| ***D06F 105/42*** | (2020.01) |
| ***D06F 23/06*** | (2006.01) |
| *D06F 33/57* | (2020.01) |

(56) References Cited

U.S. PATENT DOCUMENTS

| | | | | |
|---|---|---|---|---|
| 2002/0088502 | A1* | 7/2002 | Van Rompuy | D06F 39/024 141/1 |
| 2004/0226106 | A1* | 11/2004 | Gardner | B01D 17/0202 8/142 |
| 2004/0231371 | A1* | 11/2004 | Scheper | C11D 7/5004 68/3 R |
| 2005/0183208 | A1* | 8/2005 | Scheper | D06F 43/02 68/17 R |
| 2006/0254626 | A1* | 11/2006 | Botts | A47L 15/4217 68/17 R |
| 2008/0107576 | A1* | 5/2008 | Zettlitzer | D06F 39/02 68/17 R |
| 2009/0194562 | A1* | 8/2009 | Kessler | D06F 39/022 222/63 |
| 2011/0033318 | A1 | 2/2011 | Ramirez et al. | |
| 2014/0041418 | A1 | 2/2014 | Lee et al. | |
| 2015/0107309 | A1* | 4/2015 | Favaro | D06F 39/007 68/17 R |
| 2015/0107310 | A1* | 4/2015 | Del Pos | D06F 39/007 68/17 R |
| 2017/0334706 | A1* | 11/2017 | Kraus | D06F 39/022 |
| 2018/0334769 | A1* | 11/2018 | Irabatti | D06F 37/12 |
| 2018/0334770 | A1* | 11/2018 | Irabatti | D06F 37/12 |
| 2019/0092616 | A1* | 3/2019 | Hikem | D06F 39/022 |
| 2020/0002151 | A1* | 1/2020 | Kraus | F04B 43/0081 |
| 2021/0031220 | A1* | 2/2021 | Hikem | D06F 33/37 |

FOREIGN PATENT DOCUMENTS

| | | | | |
|---|---|---|---|---|
| DE | 102015207342 | | 10/2016 | |
| EP | 1884584 | A2 * | 2/2008 | D06F 39/022 |
| EP | 1959045 | A1 * | 8/2008 | A47L 15/4418 |
| EP | 2985464 | A1 * | 2/2016 | F04B 43/08 |
| EP | 3683349 | A1 * | 7/2020 | |
| KR | 20080089088 | | 10/2008 | |
| KR | 101097507 | | 12/2011 | |
| KR | 20140046182 | | 4/2014 | |
| KR | 20170135278 | | 12/2017 | |

OTHER PUBLICATIONS

Extended European Search Report in European Appln. No. 19884590.1, dated Nov. 22, 2022, 12 pages.

International Search Report in International Appln. No. PCT/KR2019/015630, dated Mar. 16, 2020, 5 pages (with English translation).

* cited by examiner

WASHING MACHINE

CROSS-REFERENCE TO RELATED APPLICATIONS

This application is a National Stage application under 35 U.S.C. § 371 of International Application No. PCT/KR2019/015630, filed on Nov. 15, 2019, which claims the benefit of Korean Patent Application No. 10-2018-0140638, filed on Nov. 15, 2018. The disclosures of the prior applications are incorporated by reference in their entirety.

BACKGROUND OF THE DISCLOSURE

Field of the Disclosure

The present disclosure relates to a washing machine, and more particularly, to a washing machine capable of mixing and injecting various types of additives.

Related Art

A washing machine is a device for processing laundry through various operations such as washing, dehydration and/or drying. The washing machine is a device that removes contamination from laundry (hereinafter, also referred to as "cloth") using water and detergent.

Korean Patent Publication No 10-2013-0062272 (hereinafter, also referred to as "272 patent") discloses a dispensing system capable of discharging preparations from an inside of a washing machine. The dispensing system includes a cartridge including three or more chambers containing different liquid preparations, and a dispenser detachably coupled to the cartridge. The preparations discharged from the dispenser are connected to a dispensing drawer disposed on a front surface of a main body of the washing machine through a fluid line, and a pump is provided for transferring the preparations to the fluid line.

SUMMARY

The present disclosure provides a washing machine capable of selectively discharging an additive from a pair of additive cartridges using a single pump.

The present disclosure also provides a washing machine having an improved structure of an additive dispenser for selectively supplying liquid additives discharged from a plurality of additive cartridges to a tub. In particular, the present disclosure provides a washing machine that controls the additives discharged from the plurality of additive cartridges to be selectively supplied using a single motor.

Tasks of the present disclosure are not limited to the tasks mentioned above, and other tasks not mentioned will be clearly understood by those skilled in the art from the following description.

The washing machine of the present disclosure includes a detergent mixing device configured to mix additives supplied into a tub. The detergent mixing device a pair of additive cartridges in which a liquid additive is contained, and a peristaltic pump configured to selectively supply the additive discharged from the pair of additive cartridges to the tub.

The peristaltic pump includes a flow path switching motor, first and second tubes, first and second rotors, and first and second rotary bearings. The flow path switching motor provides a rotating force for rotating the first rotor or the second rotor.

The first rotary bearing and the second rotary bearing are each configured as a one-way rotary bearing to support the first rotor and the second rotor. The first rotary bearing permits a rotation of the first rotor in a first direction and restricts a rotation of the first rotor in a second direction. In addition, the second rotary bearing permits a rotation of the second rotor in the second direction and restricts a rotation in the first direction.

The first tube guides the additive discharged from any one of the pair of additive cartridges. The first rotor is rotated in the first direction to press the first tube.

The second tube guides the additive discharged from the other of the pair of additive cartridges. The second rotor is rotated in the second direction to press the second tube.

Alternatively, in the washing machine according to another embodiment of the present disclosure, the detergent mixing device includes a plurality of additive cartridges in which a liquid additive is contained, and an additive dispenser configured to selectively supply the additive discharged from the plurality of additive cartridges to the tub.

The additive dispenser includes a first dispenser housing having a plurality of inlet ports connected to the plurality of additive cartridges, a second dispenser housing forming a predetermined space between the first dispenser housing and the second dispenser housing and having a plurality of outlet ports corresponding to the plurality of inlet ports, a rotor rotatably provided between the first dispenser housing and the second dispenser housing and having a connection pipe connecting any one of the plurality of inlet ports to any one of the corresponding outlet ports at a predetermined rotation control position, and a flow path switching motor rotating the rotor.

Details of other embodiments are included in the detailed description and drawings.

Advantageous Effects

According to the washing machine of the present disclosure, it is possible to selectively discharge additives from a pair of additive cartridges using a single pump. Therefore, it is possible to reduce the number of additive pumps used compared to a method in which one additive cartridge is connected to one additive pump.

Second, a structure of an additive dispenser for selectively supplying a liquid additive discharged from a plurality of additive cartridges to the tub can be implemented using a single motor, and thus, it is possible to simplify a structure of a product.

Effects of the present disclosure are not limited to the effects mentioned above, and other effects not mentioned will be clearly understood by those skilled in the art from the description of the claims.

DESCRIPTION OF EXEMPLARY EMBODIMENTS

Figure 1:
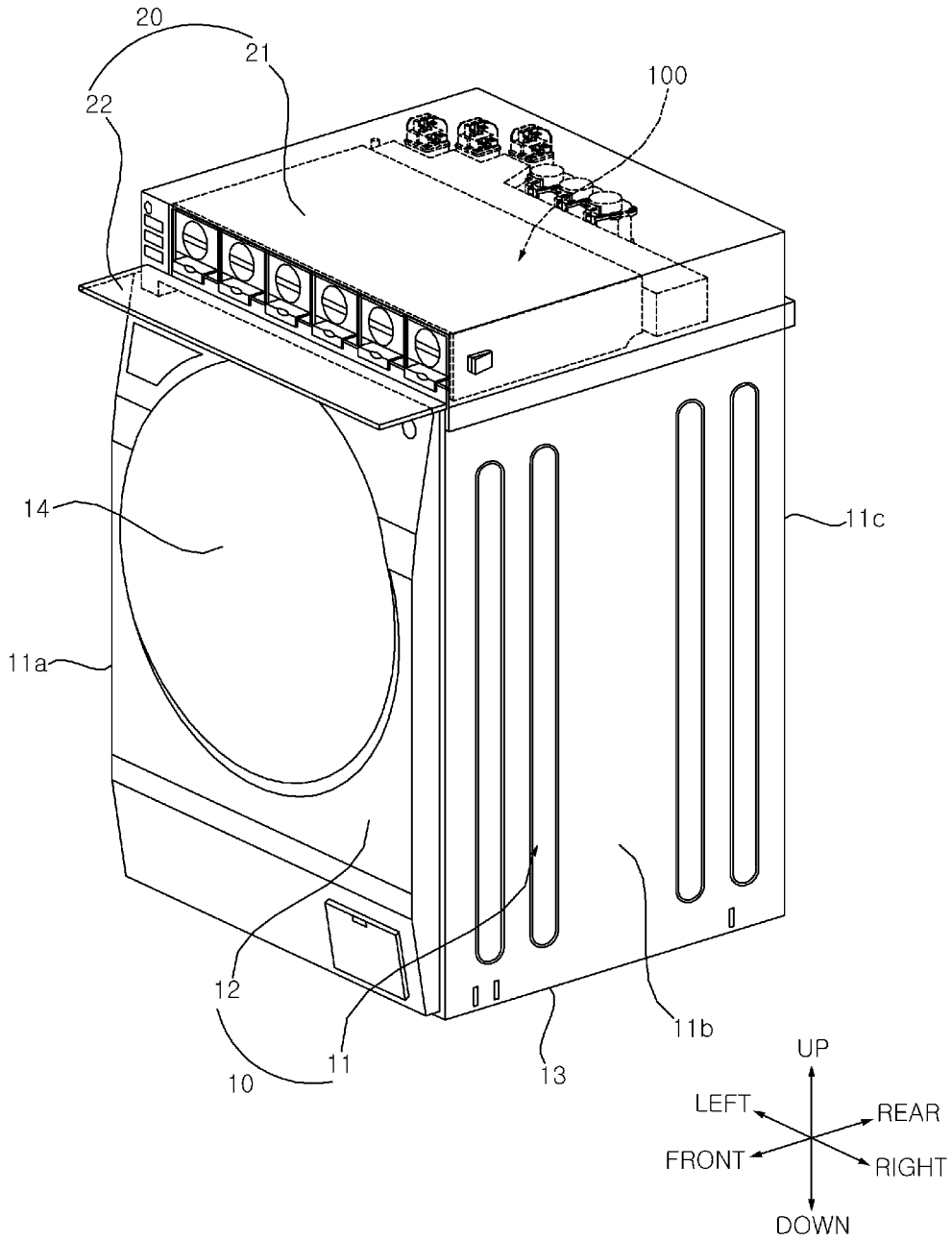
FIG. 1 is a perspective view of a washing machine according to one embodiment of the present disclosure.

Advantages and features of the present disclosure, and how to achieve them, will become apparent with reference to embodiments described below in detail in conjunction with the accompanying drawings. The present disclosure is not limited to the embodiments disclosed below, but may be implemented in a variety of different forms. That is, only the present embodiments allow the disclosure of the present disclosure to be complete and fully inform those of ordinary skill in the technical field to which the present disclosure belongs the scope of the invention, and the present disclosure is only defined by the scope of the claims. The same reference numerals refer to the same elements throughout the specification.

Figure 2:
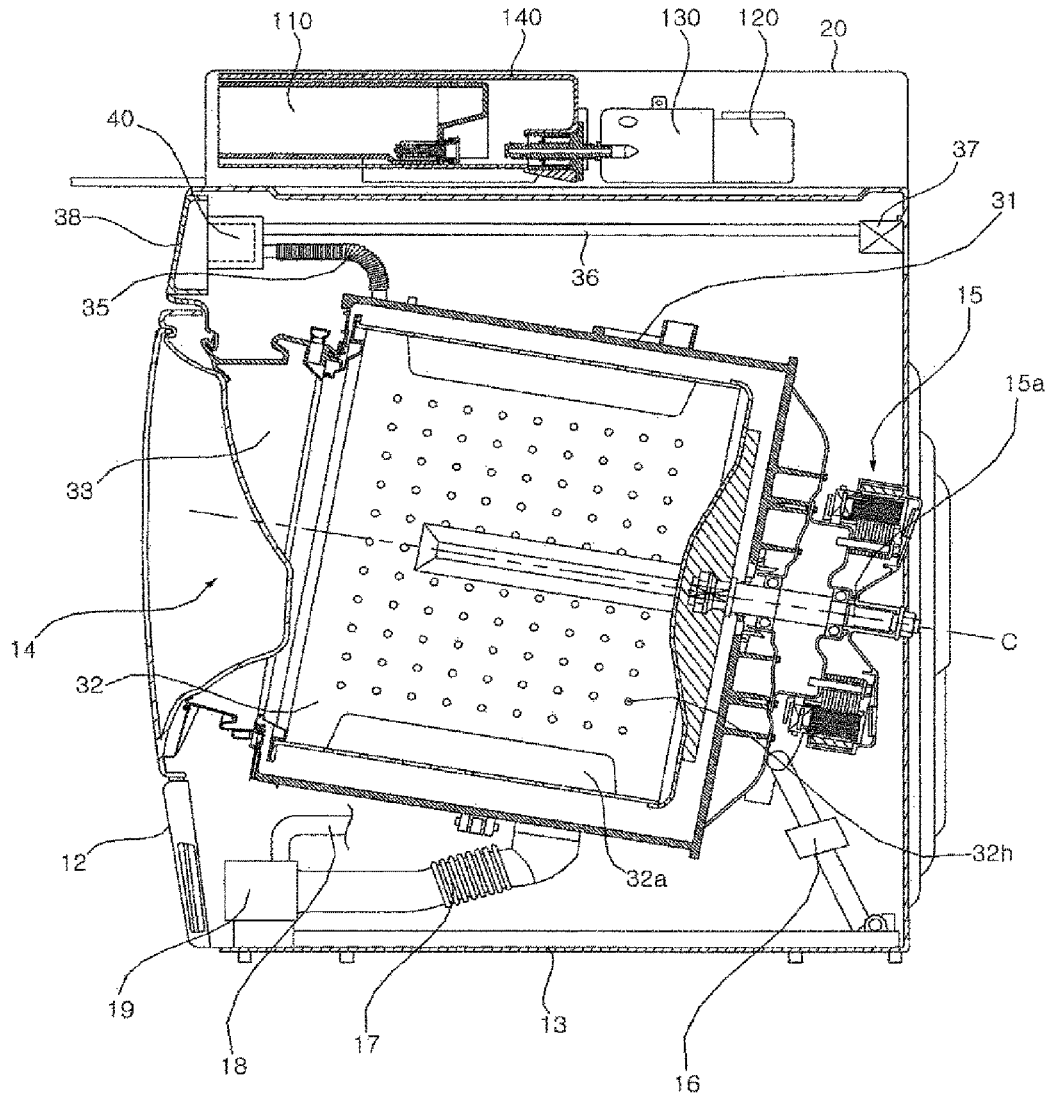
FIG. 2 is a view illustrating internal configurations of the washing machine.
Figure 3:
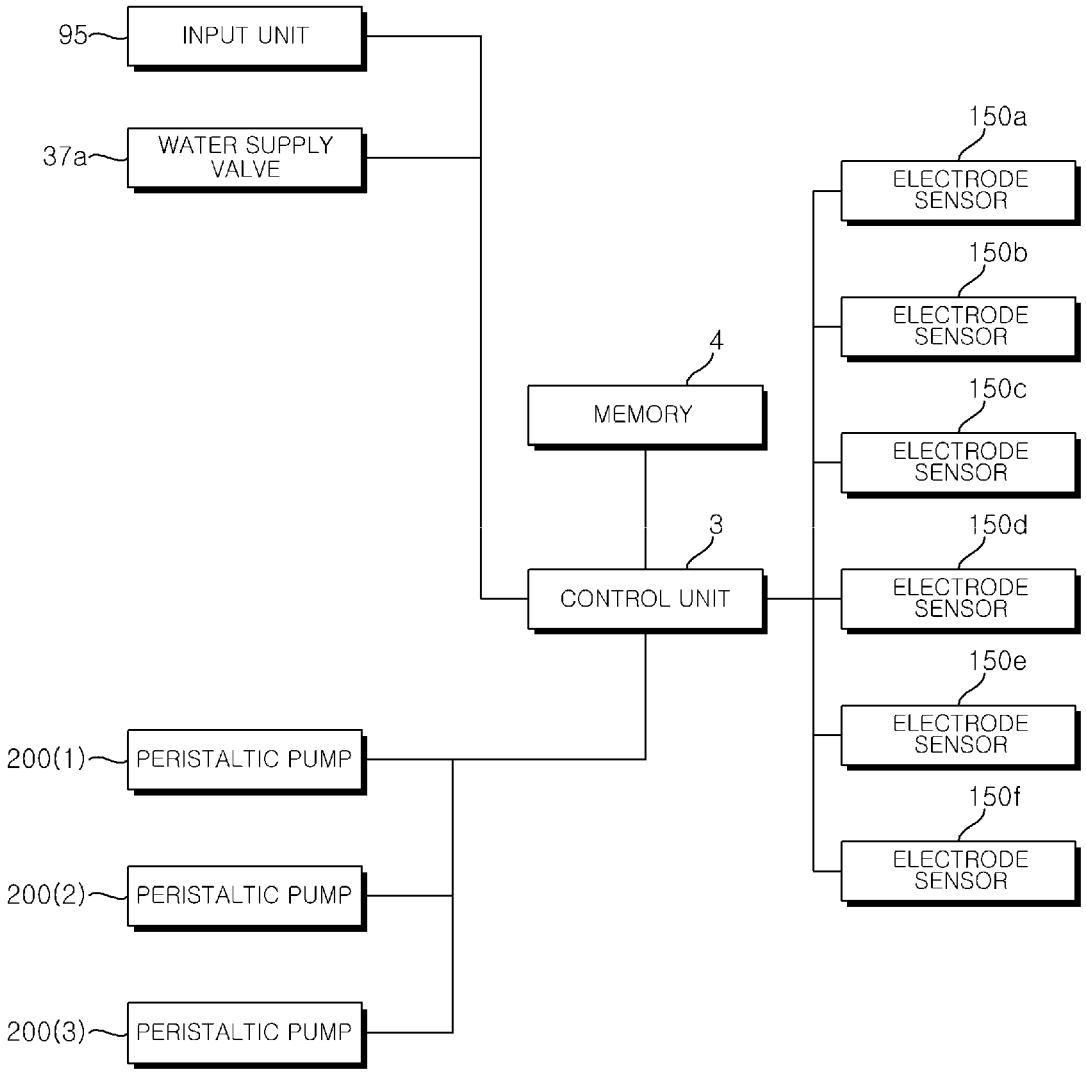
FIG. 3 is a flowchart illustrating a control relationship between main configurations of the washing machine.
Figure 4:
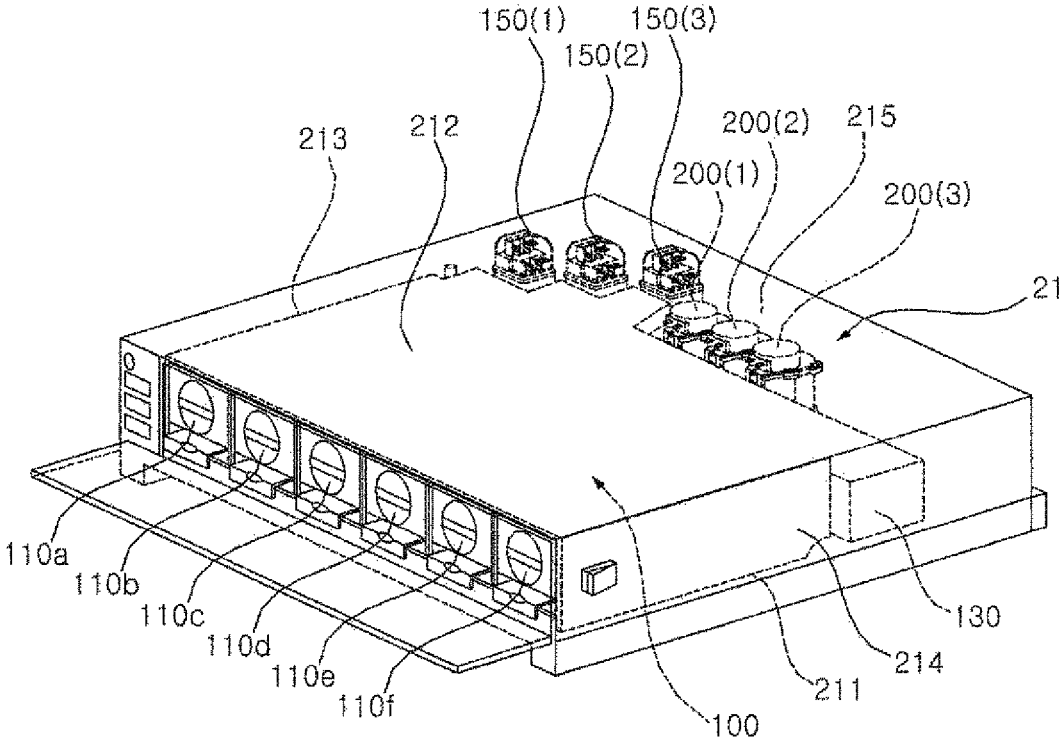
FIG. 4 illustrates an assembly of a top cover housing and a detergent mixing device.

FIG. 1 is a perspective view of a washing machine according to one embodiment of the present disclosure. FIG. 2 is a view illustrating internal configurations of the washing machine. FIG. 3 is a flowchart illustrating a control relationship between main configurations of the washing machine. FIG. 4 illustrates an assembly of a top cover housing and a detergent mixing device. FIG. 5A illustrates a process in which a cartridge is inserted into a cartridge housing and FIG. 5B illustrates a state in which a cartridge valve is open. FIG. 6 is a longitudinal sectional view of a peristaltic pump. FIG. 7A is a cross-section view taken along line A-A of FIG. 6, and FIG. 7B is a cross-sectional view taken along line B-B of FIG. 6.

Referring to FIGS. 1 to 7, a washing machine according to one embodiment of the present disclosure includes a cabinet 10 having an open top surface and a top cover housing 20 covering the open top surface of the cabinet 10.

The cabinet 10 forms an exterior of the washing machine, and provides a predetermined space in which the tub 31 and the drum 32 are accommodated. The cabinet 10 may include a main frame 11 that has an open front surface, a left surface 11*a*, a right surface 11*b*, and a rear surface 11*c*, a front panel 12 that is coupled to the open front surface of the main frame 11 and has an inlet, and a horizontal base 13 that supports the main frame 11 and the front panel 12 from below. A door 14 for opening and closing the inlet may be rotatably coupled to the front panel 12.

Referring to FIG. 2, the cylindrical tub 31 that contains water and has an open front surface and a closed rear surface may be disposed in the cabinet 10. The front panel 12 and the tub 31 are connected to each other by an annular gasket 33, and thus, a passage for laundry is formed in a section from an open inlet of a front surface of the tub 31 to the inlet of the front panel 12.

The gasket 33 has a front end portion and a rear end portion each having an annular shape, and is formed in a tubular shape extending from the front end portion to the rear end portion. The front end portion of the gasket 33 is fixed to the front panel 12, and the rear end portion thereof is fixed around the inlet of the tub 31. The gasket 33 may be made of a flexible or elastic material. In a state where the door 14 is closed, the front end portion of the gasket 33 is in close contact with a rear surface of the door 14 to prevent water in the tub 31 from leaking through the inlet of the gasket 33.

The drum 32 may be rotatably provided in the tub 31. The drum 32 accommodates the laundry, is disposed so that an inlet through which the laundry is put is located on a front surface, and rotates about an approximately horizontal axis C. However, the "horizontal" herein is not a term used in a mathematically strict sense. That is, even when the axis C is inclined at a predetermined angle with respect to the horizontal as in the embodiment, it can be said that the axis is substantially horizontal when it is closer to the horizontal rather than the vertical. A plurality of through holes 32*h* are formed in the drum 32 so that water in the tub 31 can be introduced into the drum 32.

A plurality of lifters 32*a* may be provided on an inner surface of the drum 32. The plurality of lifters 32*a* may be disposed at a predetermined angle with respect to a center of the drum 32. When the drum 32 rotates, the laundry is repeatedly lifted and dropped by the lifter 32*a*.

A driving unit 15 for rotating the drum 32 is further provided. A driving shaft 15*a* rotated by the driving unit 15 may pass through a rear surface of the tub 31 to be coupled to the drum 32.

Preferably, the driving unit 15 includes a direct-connected washing motor, and the washing motor may include a stator fixed to a rear of the tub 31 and a rotor that is rotated by a magnetic force acting between the stator and the rotor. The driving shaft 15*a* may rotate integrally with the rotor.

The tub 31 may be supported by a damper 16 installed on the base 13. Vibrations of the tub 31 generated when the drum 32 rotates are attenuated by the damper 16. Although not illustrated, according to an embodiment, a hanger (for example, a spring) for suspending the tub 31 in the casing 10 may be further provided.

At least one water supply hose (not illustrated) for guiding water supplied from an external water source such as a faucet, and a water supply unit 37 for controlling the water supplied through the at least one water supply hose so that the water is supplied to a water supply pipe 36 may be provided. The water supply unit 37 may include at least one water supply valve 37*a* for controlling the water supply pipe 36.

The cabinet 10 may include a drawer 38 for accommodating a detergent and a drawer housing 40 in which the drawer 38 is retractably accommodated. The detergent may include not only a laundry detergent but also bleach or a fabric softener. The drawer housing 40 may form a water supply guide passage for guiding the water passing through the drawer 38 to be discharged into the tub 31 when water is supplied through the water supply pipe 26.

Compartments for accommodating detergents such as the laundry detergent, fabric softener, or bleach may be partitioned in the drawer 38. After the water supplied through the water supply pipe 36 passes through the drawer 38, the water may be supplied into the tub 31 through the water supply guide passage formed in the drawer housing 40.

The water discharged from the drawer housing 40 is supplied to the tub 31 through the water supply bellows 35. A water supply port (not illustrated) connected to the water supply bellows 35 may be formed on a side surface of the tub 31.

A drain hole through which water is discharged may be formed in the tub 31 and a drain bellows 17 may be connected to the drain hole. A drain pump 19 for pumping water discharged from the tub 31 through the drain bellows 17 may be provided. The water pumped by the drain pump 19 is discharged to the outside of the washing machine through a drain hose 18.

Meanwhile, the top cover housing 20 that covers the open upper surface of the cabinet 10 and defines a predetermined accommodation space above the cabinet 10 is further provided.

The top cover housing 20 may include a housing main body 21 that has an inlet formed on a front surface and the accommodation space defined therein, and a housing cover 22 that opens or closes the inlet.

The housing main body 21 may have a rectangular parallelepiped shape with an open front surface, and include a lower plate 211, an upper plate 212, a left plate 213, a right plate 214, and a rear plate 215 defining each surface of the rectangular parallelepiped.

A detergent mixing device 100 is disposed in the accommodation space of the top cover housing 20. The detergent mixing device 100 includes a plurality of additive cartridges (110: 110*a*, 110*b*, 110*c*, 110*d*, 110*e*, and 110*f*), a plurality of peristaltic pumps (200: 200(1), 200(2), and 200(3)), and a flow box 130, which may be disposed on the lower plate 211.

Each of the additive cartridges 110*a*, 110*b*, 110*c*, 110*d*, 110*e*, and 110*f* contains a liquid additive, preferably, and each of the additive cartridges 110*a*, 110*b*, 110*c*, 110*d*, 110*e*, 110*f* has a different composition of additives. The additive cartridges 110*a*, 110*b*, 110*c*, 110*d*, 110*e*, and 110*f* are preferably three or more, and in the present embodiment, six additive cartridges are provided, but the number of the additive cartridges is not necessarily limited thereto.

The peristaltic pump 200 for supplying the additives discharged from the additive cartridges 110*a*, 110*b*, 110*c*, 110*d*, 110*e*, and 110*f* to the tub 31 is provided. One peristaltic pump 200 may control an additive supply of a pair of additive cartridges (hereinafter, the additive cartridges of 110*a* and 110*b* are taken as an example). That is, since the supply of additives through the pair of additive cartridges 110*a* and 110*b* is implemented by one peristaltic pump 200, as in the embodiment, only three peristaltic pumps 200(1), 200(2), and 200(3) are sufficient when six additive cartridges 110*a*, 110*b*, 110*c*, 110*d*, 110*e*, and 110*f* are provided.

Figure 6:
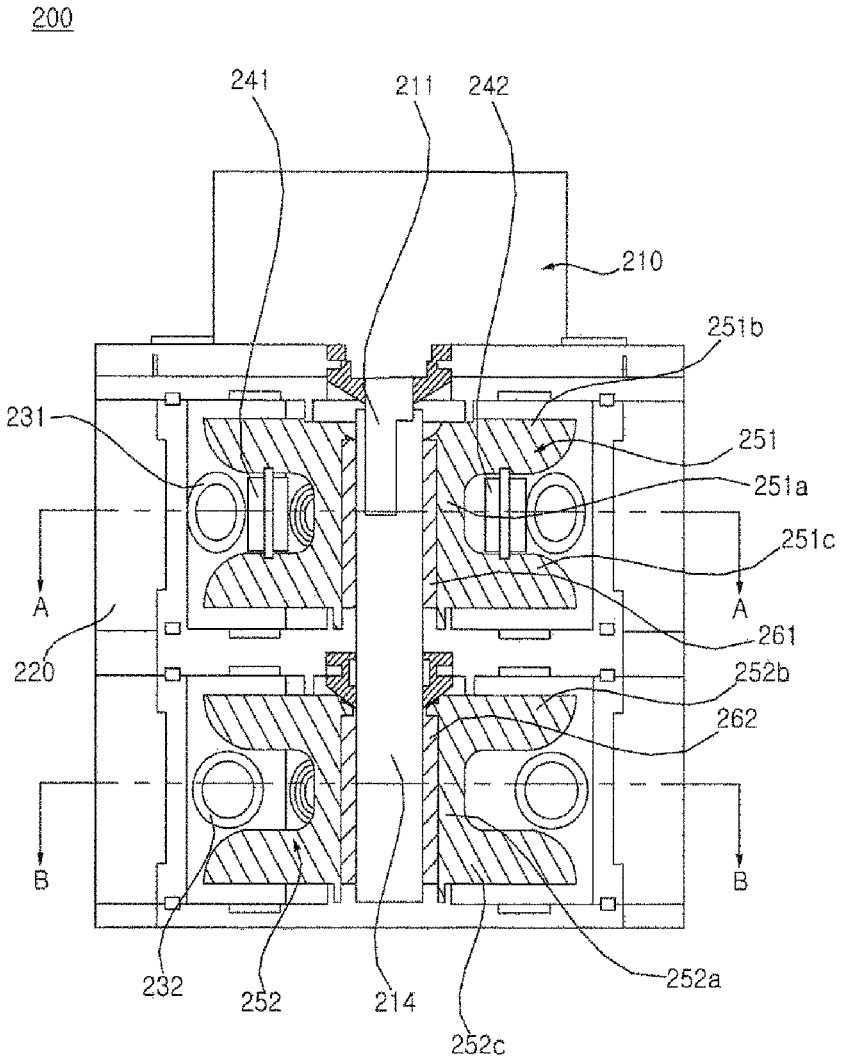
FIG. 6 is a longitudinal sectional view of a peristaltic pump.
Figure 7:
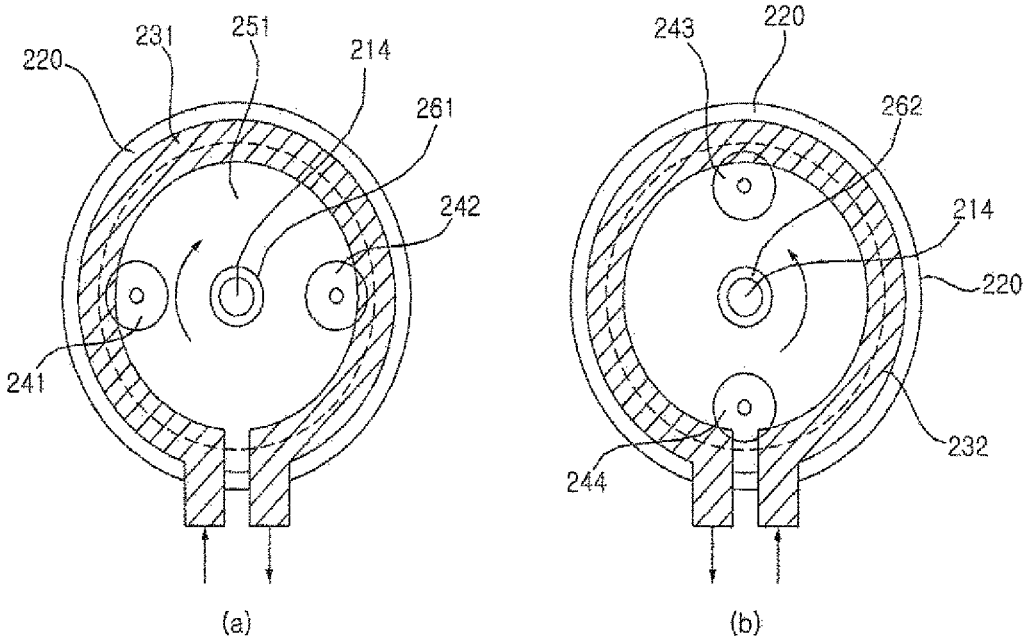
FIG. 7A is a cross-section view taken along line A-A of FIG. 6.
FIG. 7B is a cross-sectional view taken along line B-B of FIG. 6.

Referring to FIGS. 6 to 7, the peristaltic pump 200 includes a flow path switching motor 210 which provides a rotating force, a first tube 231 which guides the additive discharged from any one 110*a* of the pair of additive cartridges 110*a* and 110*b*, a second tube 232 which guides the additive discharged from the other 110*b* of the pair of additive cartridges 110*a* and 110*b*, a first rotor 251 and a second rotor 252 which are rotated by the flow path switching motor 210 and press the first tube 231 and the second tube 232, and a first rotary bearing 261 and a second rotary bearing 262 which support the first rotor 251 and the second rotor 252.

The first rotary bearing 261 and the second rotary bearing 262 are one-way bearings that allow rotation in only one direction. That is, the first rotary bearing 261 permits a rotation of the first rotor 251 in a first direction but restricts the rotation thereof in a second direction (a direction opposite to the first direction). Conversely, the second rotary bearing 262 permits a rotation of the second rotor 252 in the second direction but restricts a rotation thereof in the first direction.

When the flow path switching motor 210 is rotated in the first direction, the first rotor 251 is rotated, but the second rotor 252 is not rotated. Accordingly, the additive is discharged only through the first tube 231, and thus, only the additive contained in the first additive cartridge 110*a* is supplied.

Conversely, when the flow path switching motor 210 is rotated in the second direction, the second rotor 252 is rotated, but the first rotor 251 is not rotated. Accordingly, so that the additive is discharged only through the second tube 232, and thus, only the additive contained in the second additive cartridge 110*b* is supplied.

The peristaltic pump 200 may further include a pump case 220 which accommodates the first rotor 251 and the second rotor 252. A main body (that is, a portion accommodating a stator and a magnet) of the flow path switching motor 210 is located outside the pump case 220, and a rotation shaft 211 of the flow path switching motor 210 enters the pump case 200 and is connected (or, shaft-joined) to the drive shaft 214.

Although not illustrated, each of the first rotary bearing 261 and the second rotary bearing 262 includes an inner ring connected to the drive shaft 214 and an outer ring connected to the rotor 251 or 252, and a relative rotation of the inner ring with respect to the outer ring is permitted or restricted according to the rotation direction of the flow path switching motor 210. A one-way rotary bearing including the inner ring and the outer ring is widely known, and detailed description thereof will be omitted.

Specifically, in the case of the first rotating bearing 261, when the flow path switching motor 210 rotates in the first direction, the relative rotation of the inner ring with respect to the outer ring is not permitted. That is, when the inner ring is rotated in the first direction, the outer ring is also rotated in the first direction, and thus, the first rotor 251 is also rotated in the first direction. Conversely, when the flow path switching motor 210 is rotated in the second direction, the relative rotation of the inner ring with respect to the outer ring is permitted, and thus, the first rotor 251 is not rotated and is maintained in a stationary state.

Meanwhile, in the case of the second rotary bearing 262, when the flow path switching motor 210 rotates in the second direction, the relative rotation of the inner ring with respect to the outer ring is not permitted. That is, when the inner ring is rotated in the second direction, the outer ring is also rotated in the second direction, and thus, the second rotor 252 is also rotated in the second direction. Conversely, when the flow path switching motor 210 is rotated in the first direction, the relative rotation of the inner ring with respect to the outer ring is allowed, and thus, the second rotor 252 is not rotated and is maintained in a stationary state.

Meanwhile, each of the rotors 251 and 252 includes a pressing unit for pressing the tubes 231 and 232 made of a flexible material when the rotors 251 and 252 are rotated. In the embodiment, the pressing unit is rollers 241, 242, 243, and 244 rotatably provided on the rotors 251 and 252, but it is not necessarily limited thereto. For example, the pressing unit may be shoes, wipers, lobes, or the like.

Each of the rotors 251 and 252 includes hollow central portions 251*a* and 252*a* through which the driving shaft 214 passes, upper plate portions 251*b* and 252*b* extending radially outward from upper ends of the central portion 251*a* and

252*a*, and lower plate portions 251*c* and 252*c* extending radially outward from lower ends of the central portions 251*a* and 251*b*. The rollers 241, 242, 243, and 244 are disposed between the upper plate portions 251*b* and 252*b* and the lower plate portions 251*c* and 252*c*. The rotation shafts of the rollers 241, 242, 243, and 244 are parallel to the driving shaft 214, the upper ends thereof are connected to the upper plates 251*b* and 252*b*, and the lower ends thereof are connected to the lower plates 251*c* and 252*c*. Preferably, two or more rollers 241, 242, 243, 244 are provided on a predetermined circumference for each of the rotors 251 and 252.

The peristaltic pumps 200(1), 200(2), and 200(3) may be controlled by a control unit 3. Detergent information such as components constituting a predetermined detergent and a composition ratio of the components may be pre-stored in a memory 4. Any one of the above components is accommodated in each of the additive cartridges 110*a*, 110*b*, 110*c*, 110*d*, 110*e*, and 110*f*, and the control unit 3 may control the peristaltic pumps 200(1), 200(2), and 200(3) based on the detergent information stored in the memory 4.

The washing machine may further include an input unit 5 for receiving various control commands for the operation of the washing machine from a user. The input unit 5 may be provided at an upper portion of the front panel 12. The front panel 12 may further include a display unit 6 for displaying an operating state of the washing machine.

According to setting input by the user through the input unit 5, the control unit 3 may select a type of the detergent from the memory 4 and check detergent information accordingly. Moreover, the control unit 3 may control the operations of the plurality of peristaltic pumps 200(1), 200(2), and 200(3) in order to create the selected detergent. That is, the control unit 3 may control the additives creating the selected detergent and the operations (operation/stop operation of the pump and operation time thereof) of the additive cartridges 110*a*, 110*b*, 110*c*, 110*d*, 110*e*, and 110*f* accommodating the additives according to the composition ratio thereof and the corresponding peristaltic pumps 200(1), 200(2), and 200(3).

The top cover housing 20 may be coupled to an upper end of the cabinet 10. The top cover housing 20 may be slide-coupled to the upper end of the cabinet 10. Preferably, the top cover housing 20 may slide in a front-rear direction.

The left plate 213 and the right plate 214 of the housing main body 21 may be configured to be slidable along upper ends of the left surface 11*a* and the right surface 11*b* of the main frame 11. The top cover housing 20 is appropriately placed on the open upper surface of the cabinet 10, the housing main body 21 is appropriately moved (sliding) in the front-rear direction, and then, the top cover housing 20 may be fixed to the main frame 11 using fastening members such as screws, bolts, or hooks.

A channel box 130 includes a plurality of pump inflow paths (not illustrated) which guide the additives discharged from the plurality of additive cartridges 110*a*, 110*b*, 110*c*, 110*d*, 110*e*, and 110*f* to the plurality of peristaltic pumps 200(1), 200(2), and 200(3) and a plurality of pump discharge paths (not illustrated) which guide the additives discharged from the plurality of peristaltic pumps 200(1), 200(2), and 200(3). The pump inflow paths and the pump discharge paths may be integrally formed in the channel box 130.

The pump inflow paths are respectively connected to outlets (111*h*, refer to FIG. 5) of the corresponding additive cartridges 110*a*, 110*b*, 110*c*, 110*d*, 110*e*, and 110*f*. Accordingly, the additives discharged through the outlets 111*h* of the additive cartridges 110*a*, 110*b*, 110*c*, 110*d*, 110*e*, and 110*f* flow into the predetermined tubes 231 and 232 provided in the peristaltic pumps 200(1), 200(2), and 200(3) through any one of the pump inflow paths.

The detergent mixing apparatus 100 may further include a cartridge housing 140. The cartridge housing 140 defines a space in which the plurality of additive cartridges 110*a*, 110*b*, 110*c*, 110*d*, 110*e*, 110*f* are disposed therein. The cartridge housing 140 may be disposed in the top cover housing 20.

The cartridge housing 140 may be disposed on the lower plate 211, has a flat rectangular parallelepiped shape having a long cross-section in a right-left direction, and includes an open front surface (surface facing the front surface of the housing main body 21). The open front surface of the cartridge housing 140 communicates with the inlet of the top cover housing 20. Therefore, in order to install, remove, or replace the additive cartridges 110*a*, 110*b*, 110*c*, 110*d*, 110*e*, and 110*f*, the user may open the housing cover 22, and then draw or withdrawn the additive cartridges 110*a*, 110*b*, 110*c*, 110*d*, 110*e*, and 110*f* into or from the cartridge housing 140 through the open front surface of the cartridge housing 140.

Figure 5:
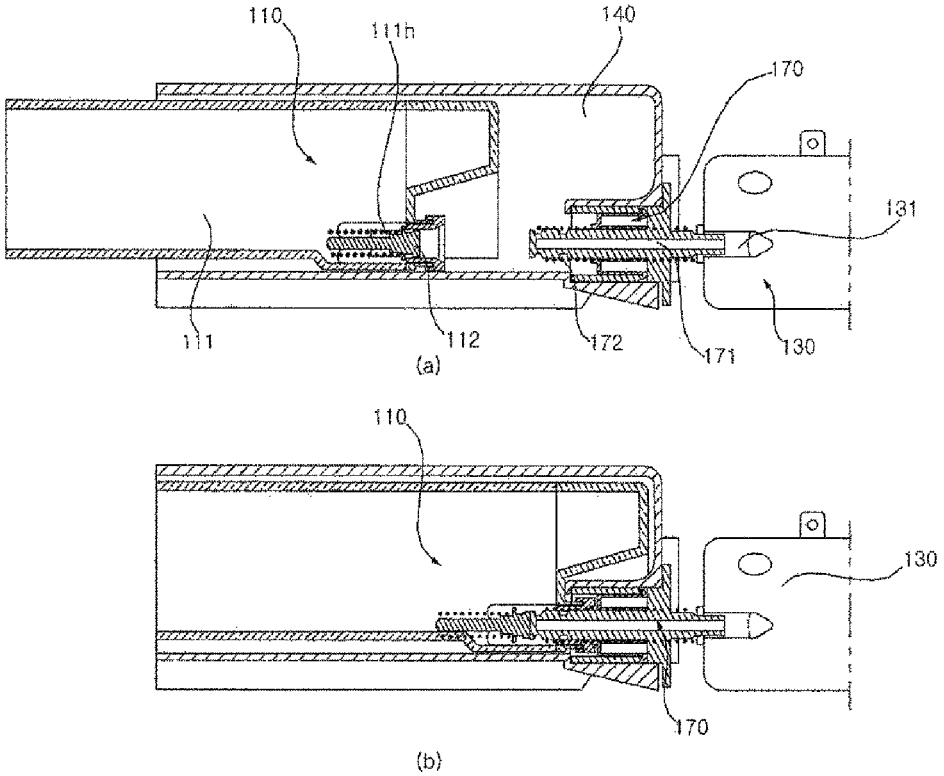
FIG. 5A illustrates a process in which a cartridge is inserted into a cartridge housing and FIG. 5B illustrates a state in which a cartridge valve is open.

Referring to FIG. 5, the additive cartridge 110 may include a container 111 in which the additive is accommodated and a check valve 112 controlling the outlet 111*h* of the container 111. The check valve 112 is opened by a cartridge connector 170 while the additive cartridge 110 is inserted into the cartridge housing 140 to open the outlet 111*h*. When the outlet 111*h* is opened, the additive in the container 111 is discharged through the outlet 111*h*, and the additive discharged in this way is connected to a predetermined inflow path formed in the channel box 130 through a connection flow path 171 formed in the cartridge connector 170.

The check valve 170 may include a valve head 171 and an elastic member 172 supporting the valve head 171. The valve head 171 is provided to be movable in input and withdrawal directions of each of the additive cartridges 110*a*, 110*b*, 110*c*, 110*d*, 110*e*, and 110*f*, and is moved while being pressed in an opposite direction (from the rear side to the front side in the embodiment) by the cartridge connector 170 in a process in which the additive cartridges 110*a*, 110*b*, 110*c*, 110*d*, 110*e*, and 110*f* are drawn into the cartridge housing 140 along a predetermined direction (from the front side to the rear side in the embodiment. The elastic member 172 is deformed in the process in which the valve head 171 moves, and when the check valve 170 is separated from the cartridge connector 170, while the deformed elastic member 172 is restored to the original state, the elastic member 172 moves the valve head 171 rearward so that the outlets of the additive cartridges 110*a*, 110*b*, 110*c*, 110*d*, 110*e*, and 110*f* are closed.

The channel box 130 may be disposed between the plurality of additive cartridges 110*a*, 110*b*, 110*c*, 110*d*, 110*e*, and 110*f* and the plurality of peristaltic pumps 200(1), 200(2), and 200(3). That is, the plurality of additive cartridges (110*a*, 110*b*, 110*c*, 110*d*, 110*e*, 110*f*) may be arranged in the right-left direction, the channel box 130 may be disposed behind the additive cartridges 110*a*, 110*b*, 110*c*, 110*d*, 110*e*, and 110*f*, and the peristaltic pumps 200(1), 200(2), and 200(3) may be arranged in the right-left direction behind the channel box 130.

Electrode sensors 150*a*, 150*b*, 150*c*, 150*d*, 150*e*, and 150*f* respectively connected to the plurality of pump discharge paths may be further provided. The plurality of electrode sensors 150*a*, 150*b*, 150*c*, 150*d*, 150*e*, and 150*f* are provided to correspond to the plurality of pump discharge paths, and detect the additives guided through the corresponding pump discharge paths.

Each of the electrode sensors 150*a*, 150*b*, 150*c*, 150*d*, 150*e*, and 150*f* outputs a signal when two positive (+) and negative (−) electrodes spaced apart from each other conduct through a medium (a liquid additive in the embodiment). Each of the plurality of electrode sensors 150*a*, 150*b*, 150*c*, 150*d*, 150*e*, and 150*f* has an inlet connected to the pump discharge path, a chamber (not illustrated) through which the additive introduced through the inlet passes through and in which the pair of electrodes is disposed, and an outlet through which the additive passing through the chamber is discharged.

The control unit 3 may determine whether the additive is normally guided through the pump discharge path based on the signal. That is, when any one of the plurality of electrode sensors 150*a*, 150*b*, 150*c*, 150*d*, 150*e*, and 150*f* does not output a normal signal (for example, a signal generated when both electrodes are electrically conductive) (for example, when the electrical connection of both electrodes is disconnected), the control unit 3 determines that the additive of the additive cartridge 110*a*, 110*b*, 110*c*, 110*d*, 110*e*, and 110*f* connected to the corresponding pump discharge path is exhausted, and may display this fact on the display unit 6 so that the user easily recognizes this fact. Meanwhile, in the embodiment, the two electrode sensors 150*a*, 150*b*, 150*c*, 150*d*, 150*e*, and 150*f* form one assembly or module 150(1), 150(2), and 150(3), but the present invention is not limited to this.

The additives discharged from the plurality of pump discharge passages may be discharged to the water supply guide passage of the drawer housing 40 through a predetermined connection flow path. However, the present invention is not limited thereto, and the additive can be supplied to an arbitrary flow path connected to the tub 31.

Figure 8:
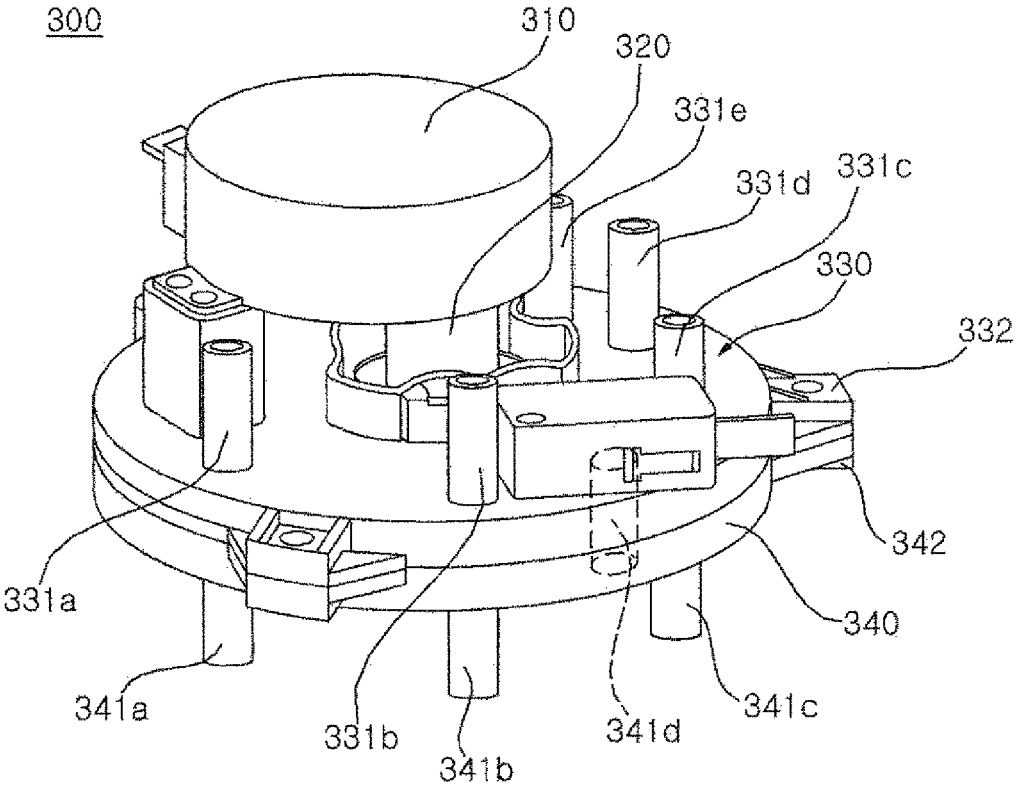
FIG. 8 is a perspective view illustrating an additive dispenser constituting a detergent mixing device according to another embodiment of the present disclosure.
Figure 9:
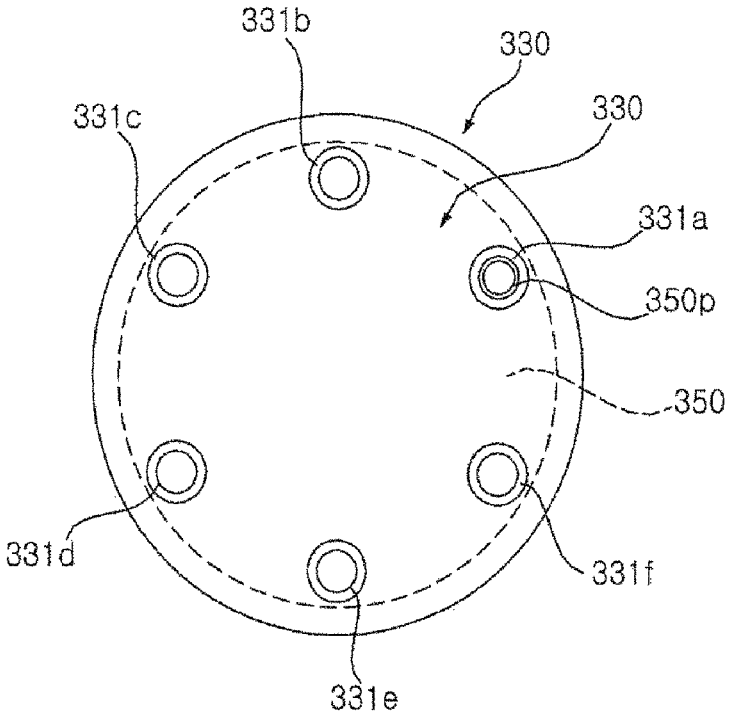
FIG. 9 schematically illustrates a state in which any one of a plurality of input ports is communicated by a connection pipe.
Figure 10:
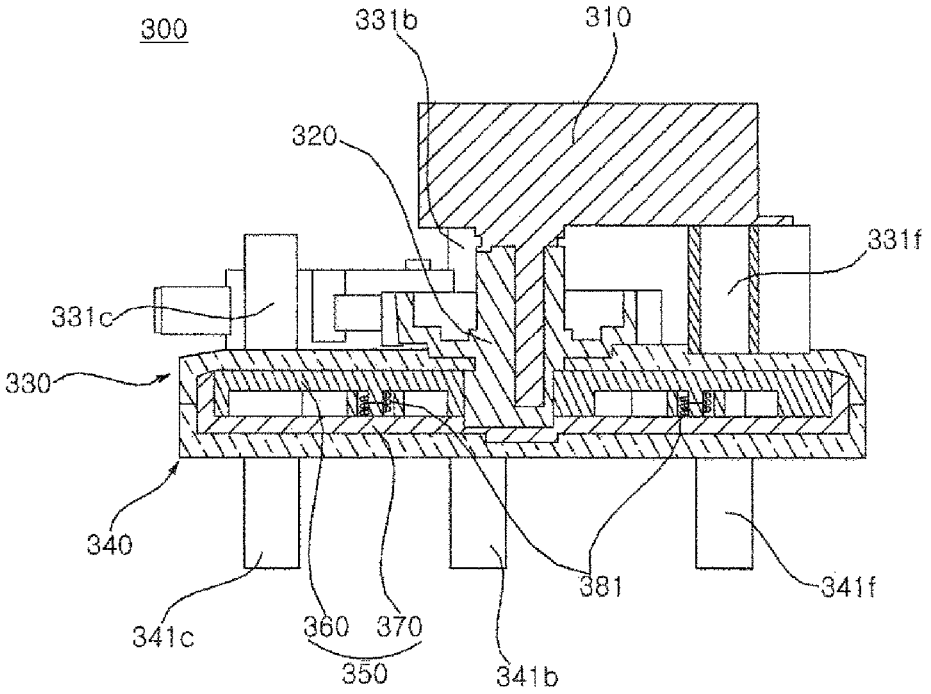
FIG. 10 is a cross-sectional view taken along line C-C of FIG. 8.
Figure 11A:
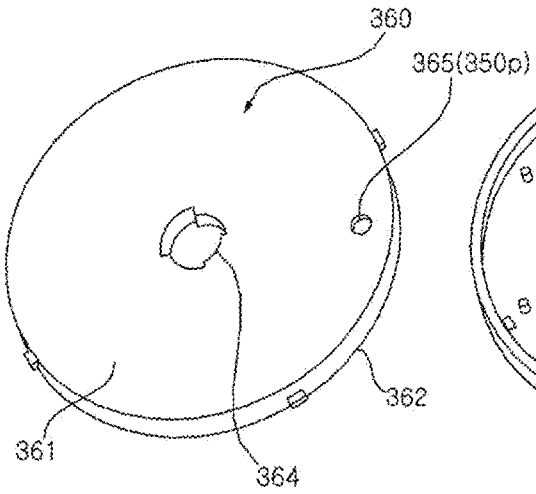
FIG. 11A illustrates a first rotating disk.
Figure 11B:
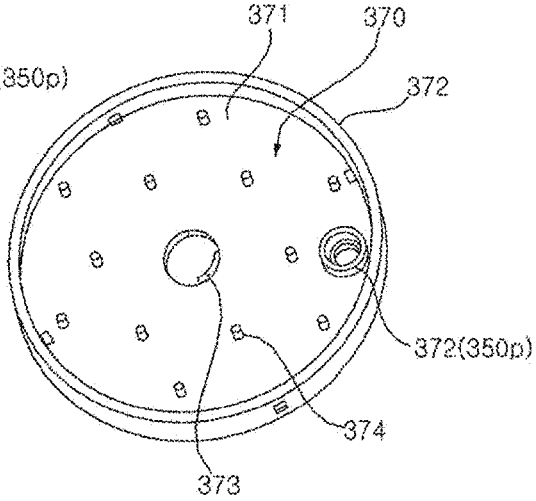
FIG. 11B illustrates a second rotating disk.
Figure 12:
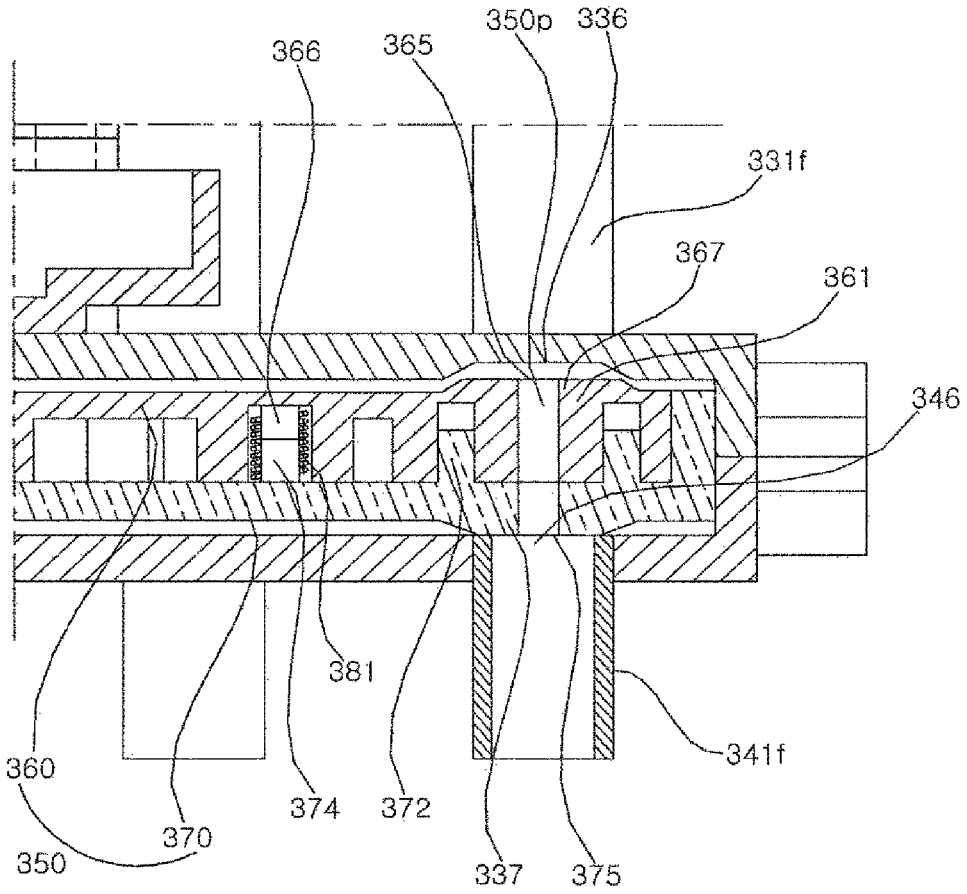
FIG. 12 is a cross-sectional view illustrating a modification example of a rotator.

FIG. 8 is a perspective view illustrating an additive dispenser constituting a detergent mixing device according to another embodiment of the present disclosure. FIG. 9 schematically illustrates a state in which any one of a plurality of input ports is communicated by a connection pipe. FIG. 10 is a cross-sectional view taken along line C-C of FIG. 8. FIG. 11A illustrates a first rotating disk, and FIG. 11B illustrates a second rotating disk. FIG. 12 is a cross-sectional view illustrating a modification example of a rotator. Hereinafter, referring to FIGS. 8 to 12, the same reference numerals are assigned to the same components as those of the above-described embodiment, and descriptions thereof will be omitted.

In the washing machine according to this embodiment, the detergent mixing device includes a plurality of additive cartridges 110*a*, 110*b*, 110*c*, 110*d*, 110*e*, and 110*f* each containing a liquid additive, and an additive dispenser 300 which selectively supplies the additive discharged from the plurality of additive cartridges 110*a*, 110*b*, 110*c*, 110*d*, 110*e*, and 110*f* to the tub 31.

The additive dispenser 300 includes a first dispenser housing 330, a second dispenser housing 340 which forms a predetermined space between the first dispenser housing 330 and the second dispenser housing 340, a rotator 350 which is rotatably provided in the space, and a motor 310 which rotates the rotator 350.

The first dispenser housing 330 includes a plurality of inlet ports 331*a*, 331*b*, 331*c*, 331*d*, 331*e*, and 331*f* respectively connected to the plurality of additive cartridges 110*a*, 110*b*, 110*c*, 110*d*, 110*e*, and 110*f*, and the second dispenser housing 340 includes a plurality of outlet ports 341*a*, 341*b*, 341*c*, 341*d*, 341*e*, and 341*f* respectively corresponding to the plurality of inlet ports 331*a*, 331*b*, 331*c*, 331*d*, 331*e*, and 331*f*.

The rotator 350 has a connection pipe 350P which connects any one of the plurality of inlet ports 331*a*, 331*b*, 331*c*, 331*d*, 331*e*, and 331*f* to any one of the corresponding plurality of outlet ports 341*a*, 341*b*, 341*c*, 341*d*, 341*e*, and 341*f* at a predetermined rotation control position.

When the rotation of the flow path switching motor 310 is controlled by the control unit 3 and the rotator 350 reaches a preset rotation control position, as illustrated in FIG. 12, a specific inflow port (for example, 331*f*) communicates with the corresponding outlet port (for example, 341*f*) through the connection pipe 350P. Accordingly, the additive introduced through the inlet ports 331*a*, 331*b*, 331*c*, 331*d*, 331*e*, and 331*f* is discharged through the outlet ports 341*a*, 341*b*, 341*c*, 341*d*, 341*e*, and 341*f* The additive discharged in this way is supplied into the tub 31 through a predetermined flow path.

The flow of the additive from the inlet ports 331*a*, 331*b*, 331*c*, 331*d*, 331*e*, 331*f* to the outlet ports 341*a*, 341*b*, 341*c*, 341*d*, 341*e*, 341*f* may be performed due to a difference in height, and in this case, the components should have a difference in height so that the additive flows through the outlet of the additive cartridges 110*a*, 110*b*, 110*c*, 110*d*, 110*e*, and 110*f*, the inlet ports 331*a*, 331*b*, 331*c*, 331*d*, 331*e*, and 331*f*, and the outlet ports 341*a*, 341*b*, 341*c*, 341*d*, 341*e*, and 341*f* in this order. However, the present invention is not limited thereto, and one or more pumps (for example, peristaltic pumps) for forcibly transporting the additive may be further provided.

The rotator 350 may include a first rotating disk 360 and a second rotating disk 370 integrally rotated with the first rotating disk 360. An inlet 365 of the connecting pipe 350P is formed in the first rotating disk 360, and an outlet 375 of the connecting pipe 350P is formed in the second rotating disk 370.

The first rotating disk 360 may include a first disk portion 361 having an opening portion 364 through which the driving shaft 314 passes at the center, and a first sidewall portion 362 extending downward from a periphery of the first disk portion 361. The inlet 365 of the connection pipe 350P is formed in the first disk portion 361.

The second rotating disk 370 includes a second disk portion 371 having a meshing groove 373 meshed with the driving shaft 314 at the center, and a second sidewall portion 372 extending upwardly from a periphery of the second disk portion 371. The second sidewall part 372 may be detachably coupled to the first sidewall part 362. Preferably, the first sidewall portion 362 and the second sidewall portion 372 may be coupled by a hook. The outlet 275 of the connection pipe 350P is formed in the second disk portion 371.

The rotator 350 may further include an elastic member 381 (refer to FIG. 12) for applying an elastic force in a direction in which the first rotating disk 360 and the second rotating disk 370 move away from each other. Fixing protrusions 366 and 374 for fixing one end of the elastic member 381 may be formed on an inner surface of the first rotating disk 360 and an inner surface of the second rotating disk 370 facing each other. The fixing protrusion 374 may be provided as a plurality of fixing protrusions, and both ends of the elastic member (for example, spring) may be fixed by a pair of fixing protrusions 366 and 374 formed on the first and second rotating disks 360 and 370.

In a state where the connection pipe 350P connects any one of the inlet ports 331*a*, 331*b*, 331*c*, 331*d*, 331*e*, and 331*f* to any one of the outlet ports 341*a*, 341*b*, 341*c*, 341*d*, 341*e*, and 341*f*, the first rotating disk 360 may close at least one inlet port other than the one inlet port. That is, other inlet ports 331*a*, 331*b*, 331*c*, 331*d*, 331*e* except for the inlet port (for example, 331*f*) communicating with the outlet port (for example, 341*f*) are closed by the first rotating disk 360, and thus, only one inlet port 331*f* and one outlet port 341*f* communicate with each other.

More specifically, in the first dispenser housing 330, a first depression 336 may be formed along the peripheries of the outlets of the plurality of inlet ports 331*a*, 331 *b*, 331*c*, 331*d*, 331*e*, and 331*f*, respectively. In this case, a first protruding portion 367 protruding in a shape corresponding to the first depression 336 may be formed on the first rotating disk 360 around the inlet of the connecting pipe 350P. In a state where the connection pipe 350P connects any one (for example, 331*f*) of the inlet ports to any one (for example, 341*f*) of the outlet ports, an area other than the first protruding portion 367 is in close contact with an area other than the depression 336, and thus, at least one inlet port other than the one inlet port is closed.

Similarly, in the state in which the connection pipe 350P connects any one (for example, 331*f*) of the inlet ports to any one (for example, 341*f*) of the outlet ports, the second rotating disk 370 may close at least one outlet port other than the one outlet port.

A second depression 346 is formed in the second dispenser housing 340 along the inlets of the plurality of outlet ports 341*a*, 341*b*, 341*c*, 341*d*, 341*e*, and 341*f*, and the second rotating disk 370 has a second protruding portion 375 protruding in a shape corresponding to the second depression 346 around the outlet of the connection pipe 350P.

In a state in which the connection pipe 350P connects any one (for example, 331*f*) of the inlet ports to any one (for example, 341*f*) of the outlet ports, an area other than the second protruding portion 375 is in close contact with an area other than the second depression 346, and thus, the second rotating disk 370 may close at least one outlet port other than the one outlet port.

Hereinbefore, exemplary embodiments of the present disclosure are illustrated and described. However, the present disclosure is not limited to the specific embodiments described above, various modifications can be made by a person with ordinary skill in the technical field to which the invention belongs without departing from the gist of the present disclosure claimed in the claims, and the modified implementations should not be understood individually from a technical spirit or perspective of the present disclosure.

What is claimed is:

1. A washing machine comprising:

a tub configured to receive water;

a drum rotatably provided in the tub and configured to receive laundry; and a detergent mixing device configured to mix additives supplied into the tub and including:

a pair of additive cartridges configured to receive a liquid additive; and a peristaltic pump configured to selectively supply the additive discharged from the pair of additive cartridges to the tub, and wherein the peristaltic pump includes:

a flow path switching motor configured to provide a rotational force;

a first tube configured to guide the additive discharged from a first cartridge of the pair of additive cartridges;

a second tube configured to guide the additive discharged from a second cartridge of the pair of additive cartridges;

a first rotor configured to be rotated by the flow path switching motor and configured to press the first tube;

a second rotor configured to be rotated by the flow path switching motor and configured to press the second tube;

a first rotary bearing supported by the first rotor, permitting a rotation of the first rotor in a first direction, and restricting a rotation of the first rotor in a second direction; and a second rotary bearing supported by the second rotor, permitting a rotation of the second rotor in the second direction, and restricting a rotation of the second rotor in the first direction, wherein the first rotor includes a first roller configured to, based on the first rotor being rotated, press the first tube, and the second rotor includes a second roller configured to, based on the second rotor being rotated, press the second tube, wherein each of the first rotor and the second rotor includes:

a hollow central portion, an upper plate portion extending radially outward from upper ends of the central portion, and a lower plate portion extending radially outward from lower ends of the central portion, and wherein the first and second rollers are disposed between the upper plate portion and the lower plate portion of the first and second rotors, respectively, and the first and second tubes are disposed between the upper plate portion and the lower plate portion of the first and second rotors, respectively.

2. The washing machine of claim 1, wherein a driving shaft connected to a rotation shaft of the flow path switching motor passes through the hollow central portion of each of the first and second rotors, and wherein each of the first rotary bearing and the second rotary bearing includes an inner ring connected to the driving shaft and an outer ring connected to the hollow central portion to allow solely unidirectional rotation of the inner ring.

3. The washing machine of claim 2, wherein rotational shafts of the first and second rollers are parallel to the driving shaft.

4. The washing machine of claim 1, wherein the first and second rollers are disposed along a predetermined circumference of the first and second rotors, respectively.

* * * * *